US005733208A

United States Patent [19]

Fazekas

[11] Patent Number: 5,733,208

[45] Date of Patent: Mar. 31, 1998

[54] MULTI-PURPOSE GOLF TOOL AND METHOD

[76] Inventor: Craig A. Fazekas, 39 Varda Landing Rd., Sausalito, Calif. 94965

[21] Appl. No.: 582,672

[22] Filed: Jan. 4, 1996

[51] Int. Cl.[6] ..... A63B 57/00

[52] U.S. Cl. ..... 473/406; 473/408

[58] Field of Search ..... 473/406, 408, 473/285, 286; D21/234

[56] References Cited

U.S. PATENT DOCUMENTS

| | | | |
|---|---|---|---|
| D. 218,836 | 9/1970 | Watanabe . | |
| D. 237,516 | 11/1975 | Yaudes . | |
| D. 247,686 | 4/1978 | Desjardins . | |
| D. 285,233 | 8/1986 | Owen . | |
| D. 290,985 | 7/1987 | Dikoff . | |
| D. 340,755 | 10/1993 | Shearer . | |
| D. 356,358 | 3/1995 | Woodruff . | |
| D. 361,815 | 8/1995 | Fazekas . | |
| 3,049,182 | 8/1962 | Pelow . | |
| 3,120,388 | 2/1964 | Doble | 473/406 |
| 3,203,700 | 8/1965 | Antonious . | |
| 3,233,802 | 2/1966 | Ludwick | 473/406 |
| 3,622,157 | 11/1971 | Hatch . | |
| 3,744,542 | 7/1973 | Stephens et al. . | |
| 3,763,515 | 10/1973 | Voss . | |
| 3,774,913 | 11/1973 | Dien . | |
| 4,063,731 | 12/1977 | Kitay . | |
| 4,315,624 | 2/1982 | Buckman . | |
| 4,453,294 | 6/1984 | Morita . | |
| 4,530,500 | 7/1985 | Kaymen | 473/406 |
| 4,535,987 | 8/1985 | Dikoff . | |
| 4,822,052 | 4/1989 | Dimmick et al. | 473/406 |
| 4,908,899 | 3/1990 | Killen | 473/408 |
| 4,974,842 | 12/1990 | Widman | 473/406 |
| 5,022,650 | 6/1991 | Madock | 473/408 |
| 5,121,519 | 6/1992 | Haugom . | |
| 5,282,616 | 2/1994 | Stacavich-Notaro | 473/406 |
| 5,295,683 | 3/1994 | Tate . | |

*Primary Examiner*—Steven B. Wong

*Attorney, Agent, or Firm*—Oppenheimer Wolff & Donnelly LLP

[57] ABSTRACT

A multi-purpose golf tool having a round recess with a surrounding wall. A magnetic post in the center of the recess holds a round metallic ball marker in the recess. By pushing down on one edge of the marker an opposite edge is lifted up over the adjacent wall and the marker can be slid forward off of the tool body into a ball marking position. A ribbed or jagged front edge allows the tool to fit into and clean golf club grooves. A pair of elongate rearwardly-extending elongate prongs are uniquely dimensioned and configured to function as both a turf repair tool and as a cleat or spike wrench.

30 Claims, 5 Drawing Sheets

FIG. 10
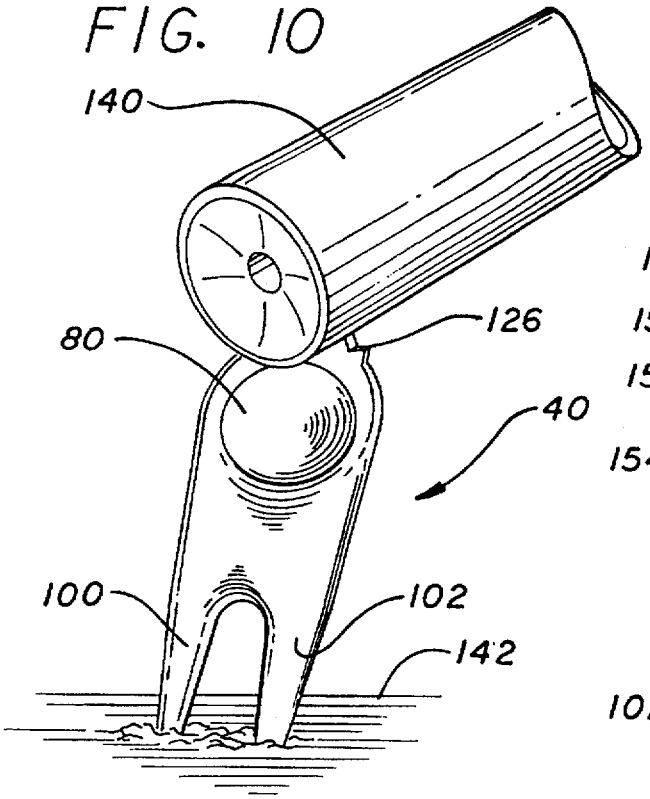
FIG. 11
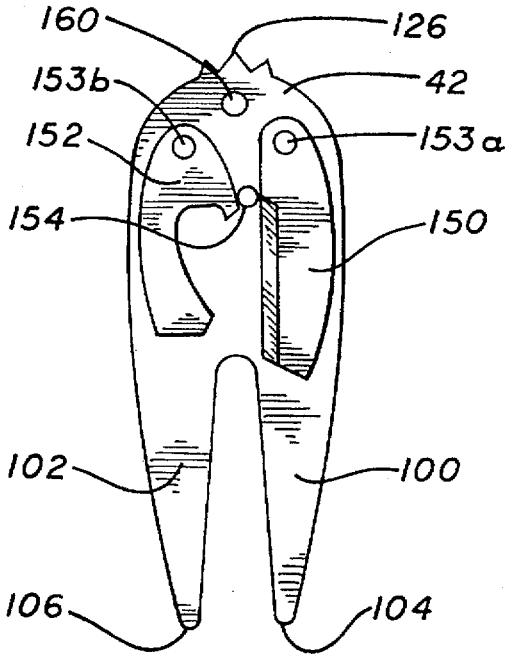
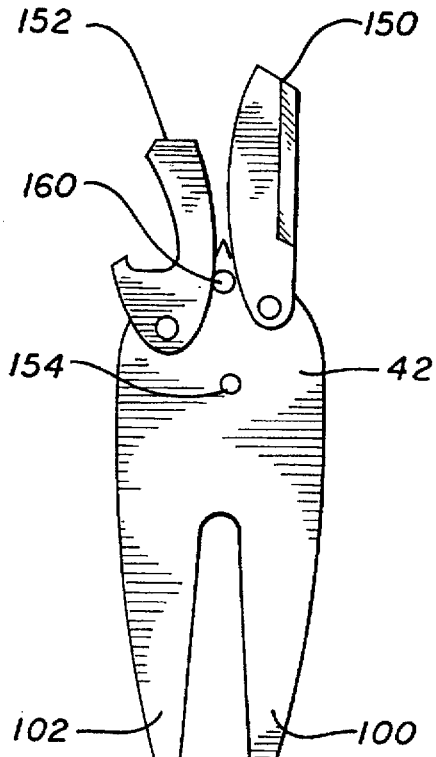
FIG. 12
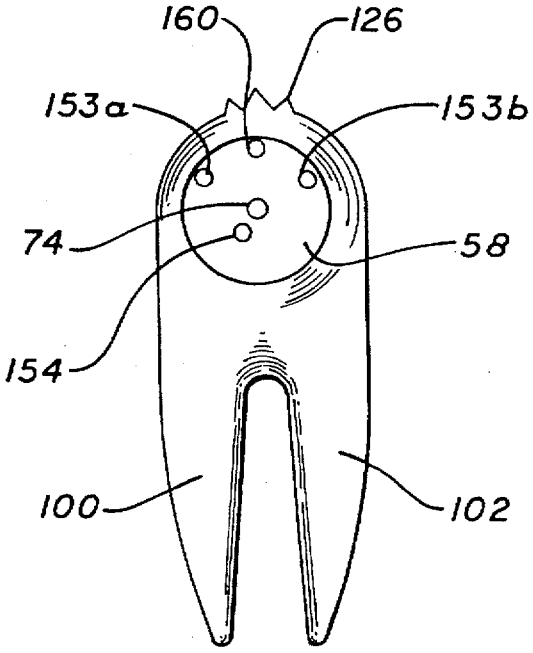
FIG. 13

FIG. 14
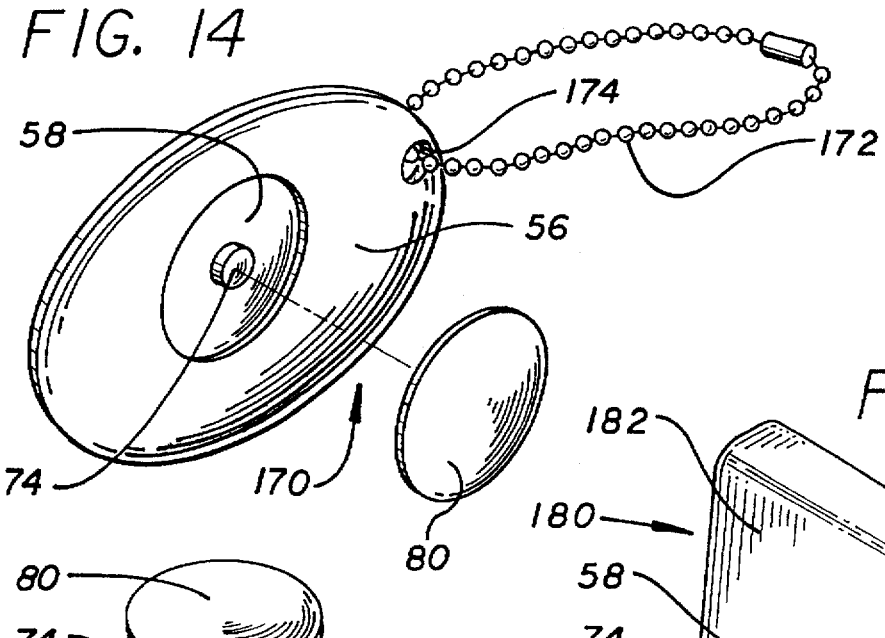
FIG. 15
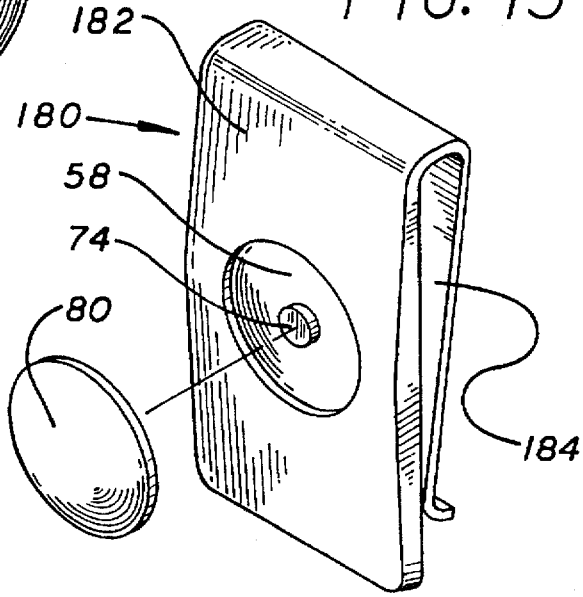
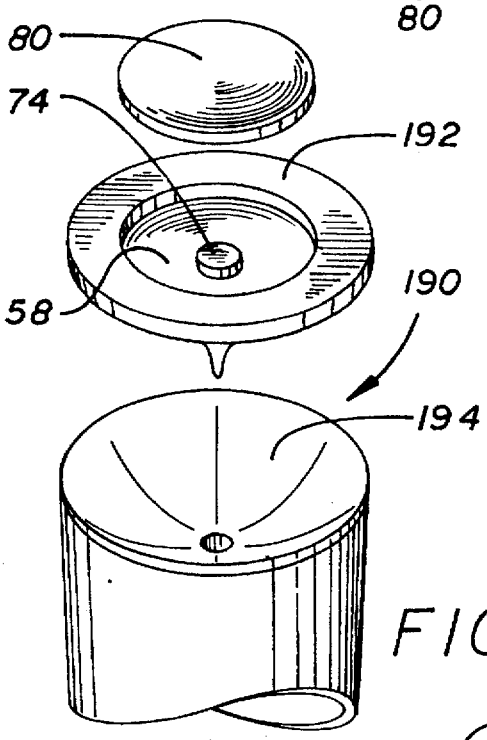
FIG. 16
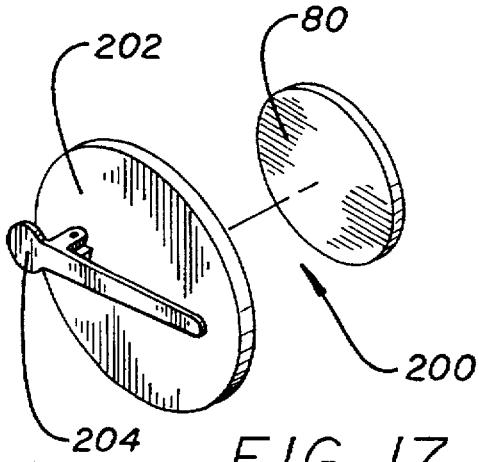
FIG. 17
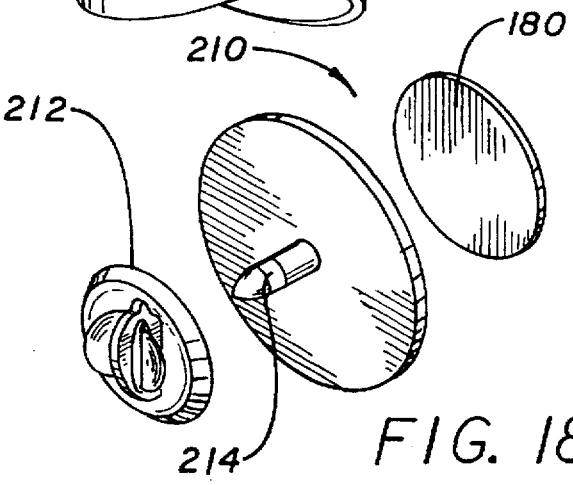
FIG. 18

MULTI-PURPOSE GOLF TOOL AND METHOD

BACKGROUND OF THE INVENTION

The present invention relates to golf tools and accessories and more particularly to golf tools having multiple applications and constructed in a single compact apparatus, and to methods of using same.

Numerous different golfers tools have been developed over the years to help the golfer with different activities experienced during golfing play. While some of the tools have only one function, others have multiple functions. The functions can include ball marker holder, club groove cleaner, cleat wrench, cigarette holder, golf club rest, knife and so forth. Examples of some of the prior golf tools are shown in the following patents (each of whose entire disclosure is hereby incorporated by reference): U.S. Pat. Nos. Des. 218,836 (Watanabe), Des. 237,516 (Yaudes), Des. 247,686 (Desjardins), Des. 285,233 (Owen), Des. 290,985 (Dikoff) and Des. 361,815 (Fazekas); and 3,049,182 (Pelow), 3,203,700 (Antonious), 3,744,542 (Stephens et al.), 3,774,913 (Dien), 3,763,515 (Voss), 4,063,731 (Kitay), 4,315,624 (Buckman) and 4,535,987 (Dikoff).

No golf tool has been designed, however, which provides for multiple functions to be conducted efficiently with a simple compact and attractive construction.

SUMMARY OF THE INVENTION

Directed to remedying the problems in and disadvantages of the prior art, an improved multi-purpose golf tool(s) and method(s) of using same are disclosed herein. The tool includes a carrier member having a round recess with a surrounding wall. A magnetic post affixed in the center of the recess releasably holds a round metallic ball marker in place in the recess. To release the marker from the carrier member and quickly, easily and accurately position it on the grass, the user simply pushes down with his thumb on one edge of the marker and then slides it over the post, the adjacent surrounding wall and the front edge of the tool and into position on the grass.

The front edge has a rough (ribbed, jagged, serrated or corrugated) configuration to fit into and clean dirt out of the face grooves of a golf club. Extending rearwardly of the carrier member are a pair of elongate prongs. The prongs and their tips are configured and dimensioned so that the tool can function both as a turf repair tool and uniquely as a cleat or spike wrench. Auxiliary can/bottle opener and/or small knife can be pivotally mounted to the back of the carrier member. The tool, and particularly the ball marker holder arrangement, can be alternatively constructed as a luggage tag, a money clip, a golf club end or a lapel pin.

Other objects and advantages of the present invention will become more apparent to those persons having ordinary skill in the art to which the present invention pertains from the foregoing description taken in conjunction with the accompanying drawings.

BRIEF DESCRIPTION OF THE DRAWINGS

FIG. 10 shows the tool being used as a golf club handle rest;

FIG. 11 is a rear elevational view of an alternative golf tool of the present invention;

FIG. 12 is a view similar to FIG. 11 showing the two auxiliary tools in pivoted operative positions;

FIG. 13 is a front elevational view of the alternative golf tool of FIGS. 11 and 12, with the ball marker removed;

FIG. 14 is a perspective view of an alternative golf tool of the invention constructed as a luggage tag;

FIG. 15 is a perspective view of another alternative golf tool constructed as a money clip;

FIG. 16 is a perspective view of a further alternative golf tool constructed as an end to a golf club;

FIG. 17 is a perspective view of a still further alternative golf tool constructed as a lapel pin; and FIG. 18 is a perspective view of a yet still further alternative golf tool constructed as a lapel pin.

DETAILED DESCRIPTION OF PREFERRED EMBODIMENTS OF THE INVENTION

Figure 1:
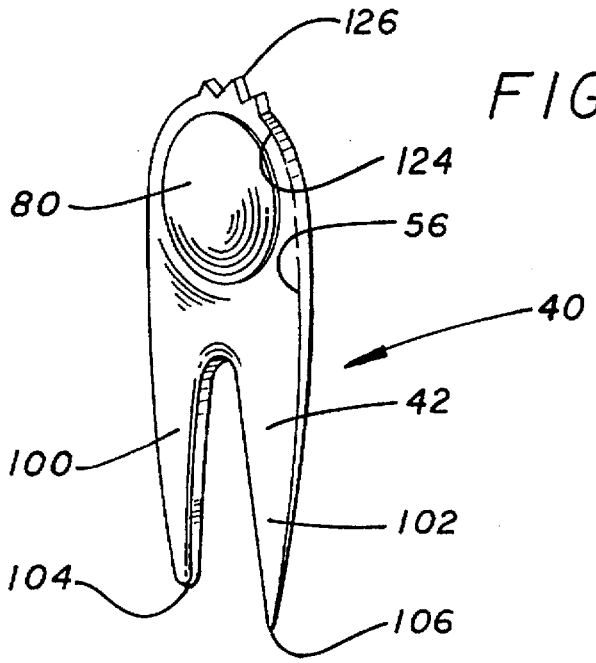
FIG. 1 is a perspective view of a multi-purpose golf tool of the present invention.
Figure 2:
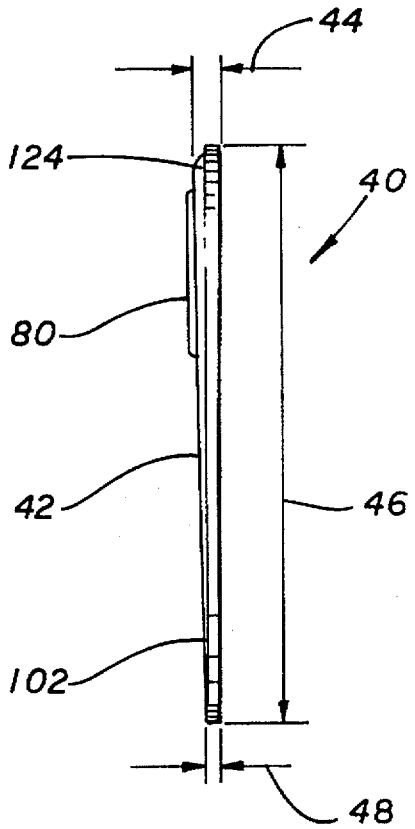
FIG. 2 is a side elevational view thereof.
Figure 3:
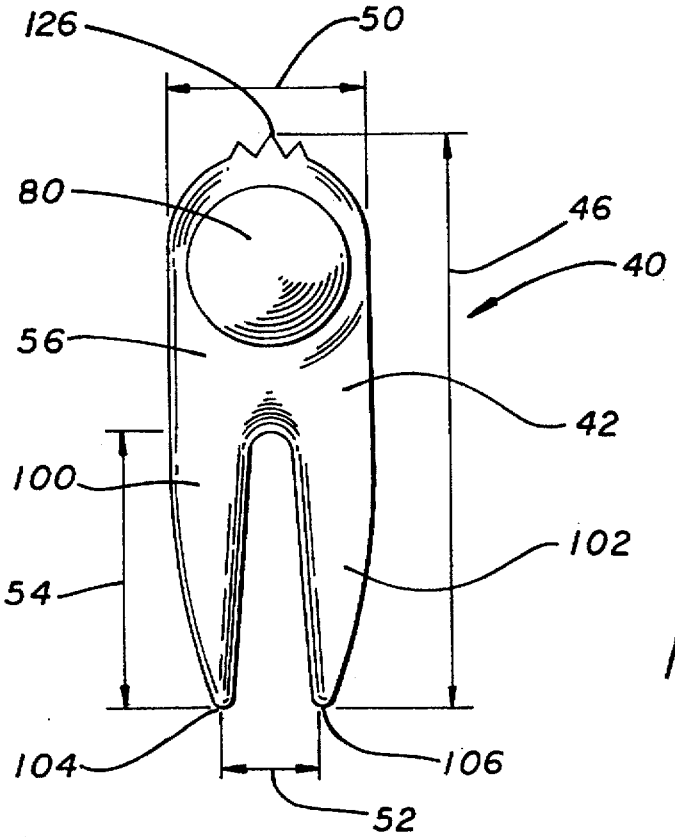
FIG. 3 is a front elevational view thereof.

Referring to the drawings, a number of embodiments of the present invention are illustrated. FIGS. 1–3 show generally at 40 and in isolation a preferred golf tool of the present invention. Golf tool 40 includes a body member 42 preferably formed of solid high quality brass having an 18k gold plating or nickel plating with a tiffany mirror finish and formed by stamping and polishing. The body member has dimensions 44, 46, 48, 50, 52 and 54 of 0.146, 2.7175, 0.045, 0.957, 0.5675 and 1.35 inches, respectively.

Figure 5:
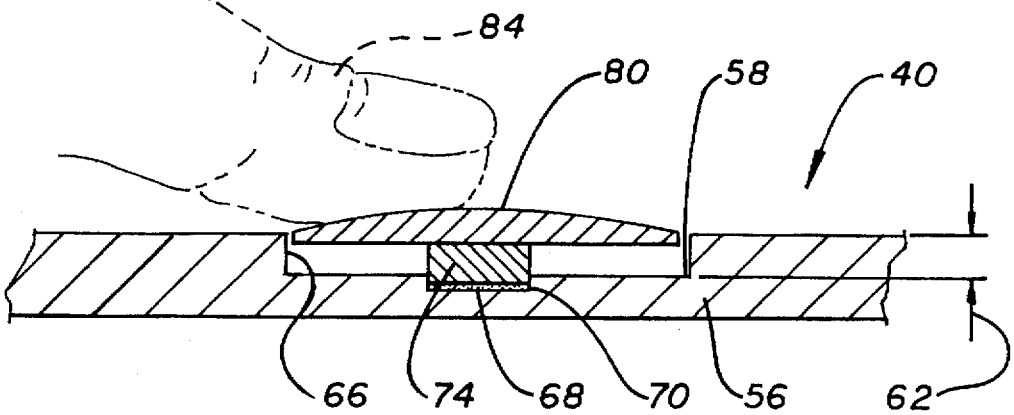
FIG. 5 is an enlarged cross-sectional view of a portion of the tool showing a user's thumb starting a marker release process of the invention.
Figure 6:
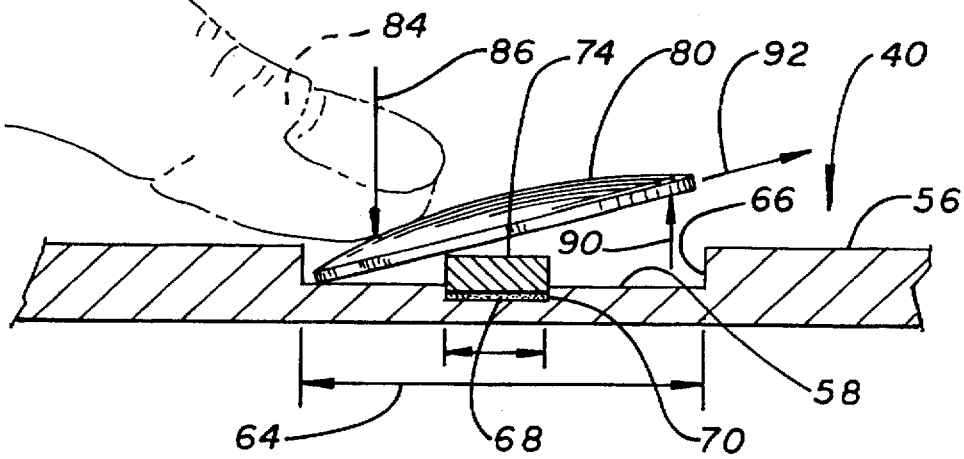
FIG. 6 is a view similar to FIG. 5 showing a subsequent marker release and positioning step.

The body member 42 includes a carrier element, member or portion 56 having a round recess 58 as shown in FIGS. 5 and 6 having a depth 62 of 0.08 inch and a width or diameter 64 of 0.69 inch. A carrier "wall" 66 surrounds the recess 58. Affixed by adhesive 68 (for example) in a hole or depression 70 in the center of recess 58 is a round magnetic post 74, comprising a plastiloy/neodymium magnet. As can be best seen in FIG. 5, post 74 has a height above the floor of the recess 58 slightly less than the depth 62 of the recess (that is, the height of the surrounding wall 66).

Figure 4:
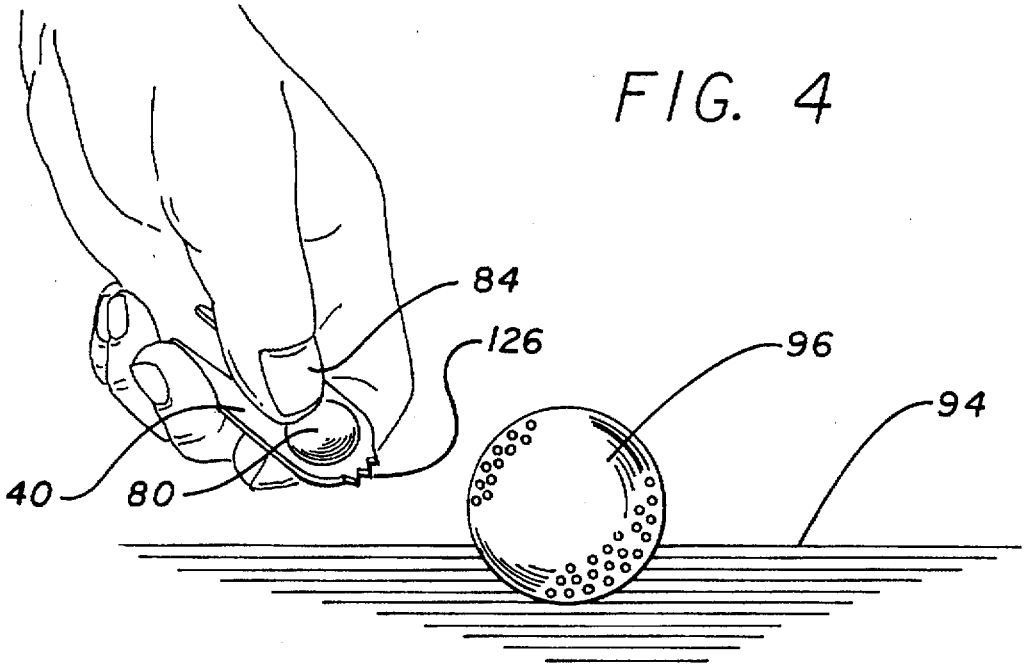
FIG. 4 is a perspective view thereof showing a ball marker thereof being deposited pursuant to this invention.

A round metallic ball marker 80 has a cloisonne or enamel top coating and a diameter of 0.69 inch. It is magnetically held on top of the post 74, as shown in FIG. 5 (and also FIGS. 1 and 3), with its lower surface in the recess 58, below the top of the surrounding wall 66. Then with the user's thumb 84 pressing down on a rear edge of the ball marker 80, as shown in FIG. 6 by arrow 86, the forward edge of the ball marker is lifted up as shown by arrow 90, with the magnetic post 74 acting as a fulcrum. The marker 80 can then be slid forward as shown by arrow 92, off of the forward edge of the body member 42 onto the grass 94 at the location of the golf ball 96 as can be understood from FIG. 4.

Figure 7:
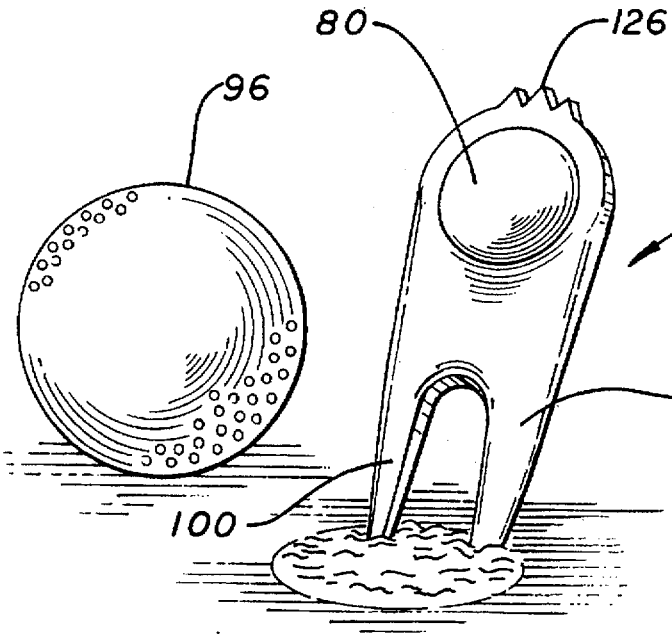
FIG. 7 is a perspective view showing the tool of FIG. 1 in a golf turf repair procedure, that is, used as a divot mender.

Extending rearwardly of the carrier element 56, and as part of the body member 42 are a pair of elongate tines or prongs 100, 102, having respective tips 104, 106. The prongs 100, 102 are long enough and otherwise dimensioned so that they can be pressed into the golf green or turf 110 and manipulated to re-form or repair damaged turf, and this procedure is illustrated in FIG. 7. Thereby the golf tool 40 functions as a divot mender.

Figure 8:
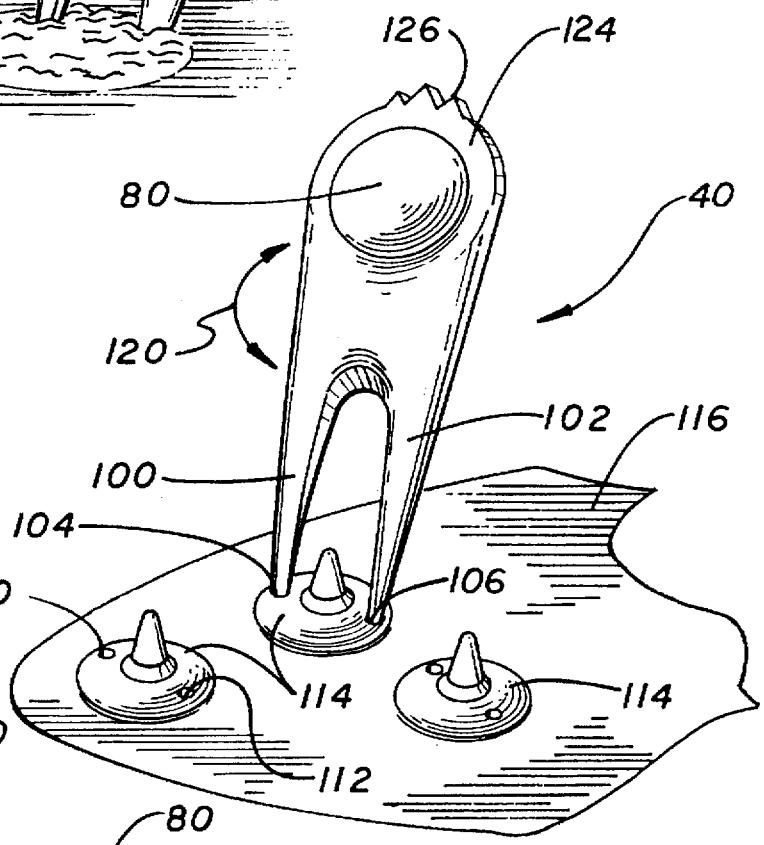
FIG. 8 is a perspective view of the tool in a golf shoe cleat or spike wrench procedure.

Referring to FIG. 8, the tips 104, 106 are also pointed and uniquely spaced apart (as shown by dimension 52) to fit onto existing openings 110, 112 in cleats or spikes 114 in the bottoms of golf shoes 116. With the tips 104, 106 in place, the body member 42 can be turned as shown by arrow 120 to loosen or tighten the cleats or spikes 114. Thereby the golf tool 40 functions in a unique manner as a cleat or spike wrench.

Figure 9:
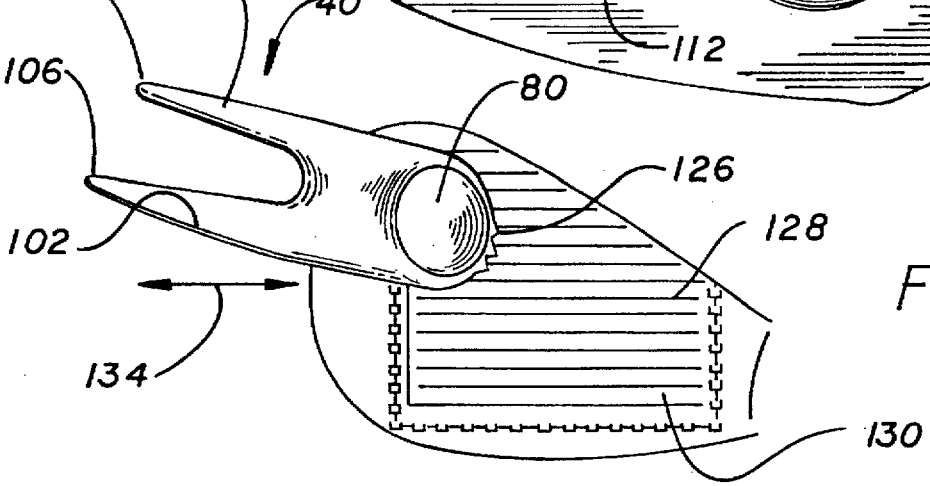
FIG. 9 shows the tool in a golf club face cleaning procedure, that is, used as a club groove cleaner.

The forward arcuate end 124 of the carrier element 56 (or body member 42) has a jagged, serrated, rough or ribbed configuration. The jags or ribs 126 are dimensioned to fit into the grooves 128 in the face of a golf club 130, as depicted in FIG. 9. And by moving the body member 42 back and forth as illustrated by arrow 134, the dirt or mud can be quickly cleaned out of the grooves 128. Thereby the golf tool 40 functions as a groove cleaner.

With the prongs 100, 102 inserted part way into the ground, golf club handle 140 can be held or supported by the ribs 126 conveniently off of the wet or chemically treated grass 142, as shown in FIG. 10.

Golfers also often desire to have convenient easy access to other tools. Accordingly an alternative embodiment of this invention provides for a small knife 150 and/or a bottle/can opener 152 to be pivotally attached at respective pivot points 154, 156 to the back side of the body member 42. The knife 150 and opener 152 can be pivoted about respective rivets 153*a*, 153*b* into folded-in positions safely not protruding out beyond the perimeter of the body member 42, as shown in FIG. 11, and against opposite sides of an abutment post or bump 154. The knife 150 and bottle/can opener 152 can then be folded out to respective accessible operative positions and against another abutment post or bump 160. Although FIG. 12 shows both the knife/file 150 and opener 152 simultaneously in open positions, it is expected for convenience and safety reasons that only one would be out at a time. FIG. 13 shows, in the recess 58, the indent sides of the bumps 154, 160, and the opposite ends of the rivets 153*a*, 153*b*.

FIGS. 1–13 show embodiments with the body member 42 as a separate tool, to be carried preferably in a protective felt pouch (not shown) in the user's pocket. Other packaging options include a clear plastic case, a leather sheath or a velvet jewelry box. Alternative embodiments of the carrier element 56 are shown in FIGS. 14–18. Referring thereto it is seen that a similar recess 58, surrounding wall 66 and magnetic post 74 are provided for the ball marker 80. The prongs (100, 102) and ribs (126) are omitted however, and a different carrying construction and/or secondary use are provided.

FIG. 14 shows generally at 170 the carrier element 56 forming a luggage tag. A chain or loop 172 passes through an opening 174 for attachment to a luggage handle (not shown). The user or owner's name, address or other identifying information can be affixed to or otherwise provided on the opposite side of the carrier element 56.

A money clip embodiment is shown generally at 180 in FIG. 15. The recess 58 is provided on the rear face of the body portion 182 of the clip 180 and the resilient clip portion 184 is attached to the body portion and functions in a known manner to hold folded paper money (not shown).

Similarly, FIG. 16 shows generally at 190 a (circular) carrier element 192 (or 56) mounted on top of a golf club 194 with a tapered mounting pin 196.

A lapel pin embodiment is illustrated generally at 200 in FIG. 17. It includes (similar to FIG. 15) a carrier element 202 (or 56) and a magnetic post (74) for a ball marker 80. Instead of the tapered mounting pin (196), it has a press-down clip 204 on the back.

FIG. 18 shows at 210 an alternative lapel pin embodiment, which includes a carrier element 210 and a conventional pinch-in butterfly clip 212. When the tabs of the clip 212 are pinched together, the clip fits onto the pin or post 214 on the back of the carrier element 210. And when they are released the clip 212 fixes onto the post 214.

From the foregoing detailed description, it will be evident that there are a number of changes, adaptations and modifications of the present invention which come within the province of those skilled in the art. However, it is intended that all such variations not departing from the spirit of the invention be considered as within the'scope thereof as limited solely by the claims appended hereto.

What is claimed is:

1. A golf tool, comprising:

a carrier member;

a round recess on said carrier member defined at least in part by a carrier member wall, said recess having a recess diameter;

a permanent-magnet post secured to a center of said recess and extending up therefrom to below a height of said carrier member wall, said post having its maximum width dimension being substantially less than the recess diameter; and a round, generally flat metallic ball marker whose diameter is less than the recess diameter, positionable in a held position magnetically held to a top of said post in said recess such that when an edge thereof is depressed down into said recess an opposing edge thereof is lifted up over said carrier member wall adjacent thereto with said post acting as a fulcrum such that said marker can be manually pushed with a sliding motion generally on said post, over said wall and off said carrier member into a desired golf ball marking position.

2. The tool of claim 1 further comprising a pair of elongate tapered prongs extending out from said carrier member, and having pointed ends spaced relative to one another and dimensioned to fit into corresponding recesses in a golfing shoe spike for removal of the spike by turning said carrier member.

3. The tool of claim 2 wherein said prongs are each approximately 1.35 inches long.

4. The tool of claim 2 wherein said prongs have their respective prong tips spaced 0.5675 inch apart.

5. The tool of claim 1 further comprising said carrier member including opposite front and back sides, said recess being on said front side, and a different auxiliary tool pivotally mounted on said back side.

6. The tool of claim 5 wherein said different auxiliary tool is a knife/file.

7. The tool of claim 5 wherein said different auxiliary tool is a can/bottle opener.

8. The tool of claim 1 further comprising a knife pivotally mounted on a back side of said carrier member and a can/bottle opener pivotally mounted on the back side pivotal in an opposite operative direction as said knife and an abutment stop peg on said back side between said knife and said opener when in respective pivoted operative positions.

9. The tool of claim 1 wherein said carrier member has a forward end and an opposite rearward end, said ball marker is slid off said forward end into the desired ball marking position, and further comprising elongate prong means extending back from said rearward end and dimensioned and configured for acting directly as a spike wrench and as a turf repair tool.

10. The tool of claim 9 wherein said elongate prong means includes a pair of elongate prongs each 0.06 inch long and having respective tips spaced 0.135 inch apart.

11. The tool of claim 1 wherein said carrier member has an arcuate forward edge with jagged means for scrape-cleaning grooves in golf club faces.

12. The tool of claim 11 wherein said forward edge is adjacent to a portion of said carrier member wall up over which said opposing edge is lifted.

13. The tool of claim 1 wherein said marker has a rounded top surface.

14. The tool of claim 1 wherein said carrier member wall completely encircles said recess.

15. The tool of claim 1 wherein said carrier member comprises a luggage tag connectable to a luggage loop connector.

16. The tool of claim 1 wherein said carrier member is a money clip having an angled biased paper money-holding component.

17. The tool of claim 1 wherein said carrier member is secured on a golf club end.

18. The tool of claim 1 wherein said carrier member comprises a lapel pin having a clip on a rear side thereof.

19. A golf play method, comprising the steps of:

providing a golf tool including a carrier member having a recess with a generally surrounding wall and a magnetic post and in a center of the recess and a metallic ball marker magnetically attached on the post and in the recess;

pushing down on an end of the ball marker and thereby lifting an opposite end thereof relative to the post; and sliding the lifted opposite end over the wall and thereby sliding the ball marker off of the carrier member and into a golf ball marking position.

20. The method of claim 19 wherein said sliding is off of a forward end of the carrier member, and the carrier member has a pair of rearwardly-extending elongate prongs having tips, and further comprising using the prong tips and the carrier member as a golf shoe cleat wrench.

21. The method of claim 20 wherein the forward end includes a ribbed surface, and further comprising cleaning a golf club face with the ribbed surface.

22. The method of claim 20 further comprising inserting the prongs into damaged golf turf and manipulating the prongs and thereby repairing the turf.

23. The tool of claim 1 further comprising a clip on a back side of said carrier member.

24. The tool of claim 1 further comprising a pair of elongate prongs extending out from said carrier member.

25. The tool of claim 24 wherein an end of said carrier member opposite to said prongs is rounded.

26. The tool of claim 24 wherein outer edges of said prongs angle towards one another.

27. The tool of claim 24 wherein said prongs are straight and lie in the same plane.

28. The tool of claim 1 further comprising a pair of members extending out from said carrier member and configured to define a golf shoe cleat wrench.

29. The method of claim 19 wherein wrench tips extend out from the carrier member, and further comprising using the wrench tips and the carrier member as a golf shoe cleat wrench.

30. The method of claim 19 wherein the carrier member has a pair of elongate prongs, and further comprising inserting the prongs into damaged turf to repair the turf.

* * * * *